United States Patent [19]

Tanaka et al.

[11] 4,382,979

[45] May 10, 1983

[54] METHOD OF MANUFACTURING A FLUORESCENT DISPLAY APPARATUS

[75] Inventors: Kazunori Tanaka; Hitoshi Toki; Hisashi Miyazawa; Goro Eto, all of Mobara, Japan

[73] Assignee: Futaba Denshi Kogyo K.K., Chiba, Japan

[21] Appl. No.: 194,398

[22] Filed: Oct. 6, 1980

Related U.S. Application Data

[63] Continuation of Ser. No. 11,996, Feb. 14, 1979, abandoned.

[30] Foreign Application Priority Data

Feb. 14, 1978 [JP] Japan ..... 53-15000

[51] Int. Cl.[3] ..... H05B 33/10; B05D 3/02

[52] U.S. Cl. ..... 427/68; 427/108; 427/157; 427/226; 427/379; 427/380

[58] Field of Search ..... 427/108, 379, 380

[56] References Cited

U.S. PATENT DOCUMENTS

| | | | |
|---|---|---|---|
| 2,312,229 | 2/1943 | Anderson | 427/67 |
| 3,625,733 | 12/1971 | Mansur | 427/96 |
| 3,661,615 | 5/1972 | Gray et al. | 427/96 |
| 3,779,807 | 12/1973 | Taylor et al. | 427/226 |
| 4,020,191 | 4/1977 | Nagashiro et al. | 427/68 |
| 4,025,669 | 5/1977 | Greenstein | 427/226 |
| 4,047,073 | 9/1977 | Kishino | 313/519 |
| 4,119,745 | 10/1978 | Smith | 427/64 |
| 4,132,920 | 1/1979 | Kobayakawa et al. | 427/64 |
| 4,155,030 | 5/1979 | Chang | 340/781 |

*Primary Examiner*—John D. Smith

*Attorney, Agent, or Firm*—Oblon, Fisher, Spivak, McClelland & Maier

[57] ABSTRACT

A method of manufacturing a fluorescent display apparatus divided into a plurality of sections each having a plurality of anode conductors disposed on a base plate made of an insulating material, wherein phosphor layers are applied on the anode conductors in each of the sections using phosphors of different luminous colors to obtain a plurality of display sections for illuminating different luminous colors upon impingement of electrons, comprising the steps of forming a first phosphor paste comprising a phosphor compound capable of emitting a particular luminous color, a volatile solvent and a solid film forming element decomposable by the application of heat at a temperature higher than the volatilization temperature of the solvent; forming a second phosphor paste consisting of a phosphor compound capable of emitting a particular luminous color different from that of the first phosphor paste and a volatile solvent; screen printing the first paste to the anode conductors of at least one section of the display apparatus; nextly volatilizing the solvent of the first screen printed paste at a temperature above the volatilization temperature of the solvent and below the decomposition temperature of the solid film forming element to transform the solid film forming element into a solid film; depositing the second paste on the anode conductors of the remaining section of said display apparatus and baking the base plate with the phosphor films formed thereon to eliminate the film forming element from the first phosphor paste, leaving only the respective phosphor compound on the anode conductors on each respective display section.

4 Claims, 8 Drawing Figures

METHOD OF MANUFACTURING A FLUORESCENT DISPLAY APPARATUS

This is a continuation, of application Ser. No. 011,996 filed Feb. 14, 1979, abandoned.

BACKGROUND OF THE INVENTION

1. Field of the Invention:

This invention relates to a method of manufacturing a fluorescent display apparatus, the display area of which locally varies in luminous color in response to input signal.

2. Description of the Prior Art:

A fluorescent display apparatus provided with a filamentary cathode and a plurality of anodes having a phosphor layer applied thereon is known. Electrons emitted from the cathode are directed to selectively impinge upon the anodes to excite them for emitting light, thereby effecting displays of letters, patterns, etc. The fluorescent display apparatus can be driven at a relatively low voltage and is low in power consumption, and accordingly it is widely used as display device in various electronic instruments such as electronic desk calculators and digital clocks, as a digital display device in various measuring instruments and wireless instruments, as level meters in audio instruments, as analog display device in speed meters for motor vehicles, etc.

Phosphors which are used to form the phosphor layer applied on the anode in the fluorescent display apparatus must have a property such that the phosphor can be excited by electrons which have been accelerated by a relatively low anode voltage, so-called low speed electron beam, to emit light with sufficient luminescence for display, and ZnO:Zn system phosphors have generally been used.

The ZnO:Zn system phosphor is advantageous in that the value of the light emitting threshold voltage i.e., the, so-called dead voltage, is as low as the order of 1 to 2 V, and that, in ordinary display apparata of small-and-medium-types, sufficient luminescence for display can be obtained by an anode voltage of 20 V or less. The luminescence spectrum is in the vicinity of 504 nm, thus green light is obtained which is easy to see.

With the expanded application of the fluorescent display apparatus, a fluorescent display apparatus which can display luminous color other than green is required, depending upon the particular application and the nature of the input signal to be displayed.

In answer to such requirements, phosphors which can emit luminous color other than green have been developed and come into actual use, such as, for example, phosphors which are made of $Y_2O_3$ or $Y_2O_2S$ activated with Eu and which contain an adequate quantity of $In_2O_3$ of ZnO for reducing resistance and can emit red luminous color upon impingement of low speed electron beam; and phosphors made of ZnS activated with Ag and coated with Cu or containing an adequate quantity of $In_2O_3$ or ZnO for reducing resistance and which emit blue luminous color upon impingement of low speed electron beam.

With the advent of such various phosphors which can emit a luminous color other than green, the fluorescent display apparatus, which can display any desired colors in accordance with the environment and the application, has been manufactured. Further, there is a demand for a fluorescent display apparatus which can emit different luminous colors from different regions within the apparatus. Such an apparatus will be useful for a digital display apparatus because it can increase amount of information to be displayed or make reading of information to be displayed easier. In addition, such an apparatus can be applied to an analog display apparatus for indicating a warning signal or permitting direct observation of value of shift exceeding a set value.

When manufacturing the fluorescent display apparatus which includes two or more display regions, displaying different luminous colors from one another, the following problems are encountered.

One of the problems is that it is technically very difficult to apply, with one step of application process, two or more sorts of phosphors having different luminous colors with respect to one another on anode conductors which have been formed in different sections on an anode substrate. Accordingly, at present, as a rule, the respective sorts of phosphors having different luminous colors are applied to the anode conductors disposed in different sections by repeating a coating step two or more times.

In this case, however, if the coating of the phosphor is applied with the use of printing technique, a phosphor layer which has been printed in a first step can be crushed in the following second step by pressure by the printing screen, which results in a decrease of luminous efficiency.

Further, in the second printing step, the printing face of screen applies pressure on the prior printed phosphor layer, and accordingly the printing face can be stained with the phosphor of this prior printed phosphor layer. This staining phosphor can, in the second step, locally mix with the second printed phosphor layer, resulting in an unsightly luminescence of the second phosphor layer.

On the other hand, when the phosphor is applied using an electrodeposition technique, some of the phosphors which have been deposited in a first electrodeposition step will, in the following second electrodeposition step, attach on the surface of the second deposited phosphor layer thereby staining it. When the anode substrate, which has been fabricated through these two steps of electrodeposition, is used to manufacture the fluorescent display apparatus, the phosphor layer which has been locally stained with the other sort of phosphor, emit upon the impingement of electrons, respective luminous colors corresponding to the various phosphers from the anodes so stained. Thus a display of predetermined colors is unobtainable, and the display realized is unsightly.

SUMMARY OF THE INVENTION

The invention has been accomplished to solve the above-described problems.

Accordingly, it is an object of the present invention to provide an improved method of manufacturing a fluorescent display apparatus which has in one display apparatus a plurality of display regions of different luminous colors.

According to the invention, in printing steps except the final printing step, phosphor layers are printed with phosphor paste which contains a binder and a solvent. This binder has properties that the binder forms a solid film upon volatilization of the solvent, and that the binder can be eliminated from the printed phosphor layer by heating at a predetermined temperature, thus being unobstructive to efficiency of luminescence of the phosphor layer effected by impinge of electrons. After each printing step, the solvent contained in the printed phosphor layer is volatilized to form a solid film due to the binder. This solid film is, in the succeeding printing steps, used as a protective film for the prior printed phosphor layer. Upon completion of printing all of the phosphor layers, the phosphor layers are baked at a predetermined temperature to eliminate the binder. Thus, all the phosphor layers, which are in different regions on the anode base plate and have different luminous colors, can be fabricated by the used of printing technique without causing any reduction in luminous efficiency in each of the regions.

and

Figure 6:
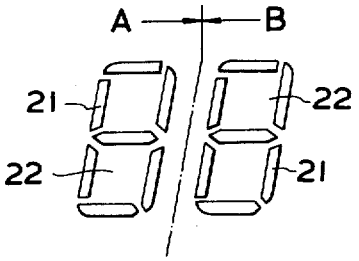
Figure 7:
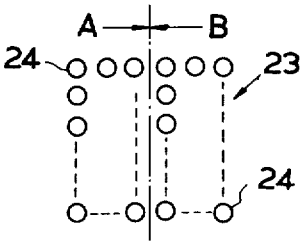
Figure 8:
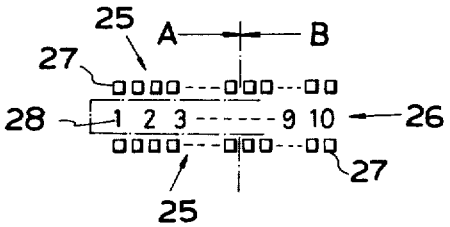

FIGS. 6 to 8 show display patterns in the fluorescent display apparatus manufactured by the method of the present invention.

DESCRIPTION OF THE PREFERRED EMBODIMENTS

A method of manufacturing fluorescent display apparatus according to the present invention will now be described in connection with the drawings. First, the description will be made taking as an example a level meter of analog display type which is used, for example, as an acoustic volume indicator in audio instruments, or a power level indicator in various electronic appliances.

Figure 1:
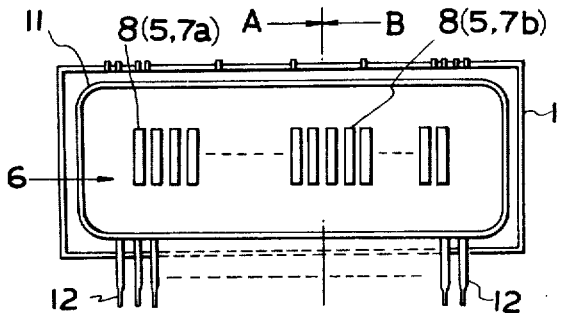
FIG. 1 is a plan view illustrating an example of a fluorescent display apparatus manufactured by the method of the present invention.
Figure 2:
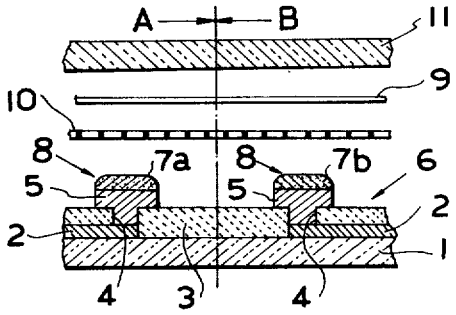
FIG. 2 is a partial enlarged sectional view of the fluorescent display apparatus shown in FIG. 1.

FIGS. 1 and 2 are a plan view and an enlarged partial sectional view, respectively, illustrating an example of the fluorescent display apparatus manufactured according to the method of the present invention.

The fluorescent display apparatus shown in FIGS. 1 and 2 comprises a base plate 1 of an insulator, glass or ceramics for example. Wiring conductors 2 are applied to the surface of the base plate 1 in a predetermined pattern by printing for example and covered with an insulating film 3. The insulating film 3 is provided with through-holes 4 communicating with the wiring conductors 2, and anode conductors 5 made of conductive material are formed on the surface of the insulating film 3 for electrically interconnecting corresponding wiring conductors 2 through the through-holes 4 thereby forming an anode substrate 6 as shown in the partial sectional view of FIG. 3.

The upper surface of the anode conductors 5 has deposited thereon a phosphor layer *7a* or *7b* (to be described later) to form anodes 8. In the embodiment shown in FIG. 1, the anodes 8 are arranged in a linear fashion for forming a display pattern. Input information is indicated by linearly illuminating a certain number of the anodes 8 corresponding to the input information.

In the fluorescent display apparatus shown in FIG. 1, the linearly arranged anodes 8 are divided into two sections A and B. The anodes in each of the sections emit different luminous color. With the use of the fluorescent display apparatus shown in FIG. 1, a warning signal or the magnitude of an input signal beyond the upper or lower limit can be easily displayed by changing the luminous color of the anodes 8 at the section in which to indicate the excess of the input signal over the set value.

Reference is now made to a method of applying the phosphor layers *7a* and *7b* according to the present invention.

Figure 3:
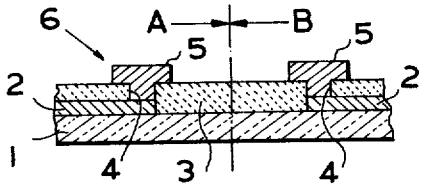
FIGS. 3 to 5 show steps of manufacturing the fluorescent display apparatus according to the present invention.

First, the phosphor layers *7a* are applied to the anode substrate 6 in the section A which is formed of the base plate 1, the wiring conductor 2, the insulating film 3 and the anode conductors 5 in the laminated manner as shown in FIG. 3 according to the process described hereinabove.

A phosphor for forming the phosphor layers *7a* may be selected from a ZnO:Zn system phosphor which emits green light upon impingement of thermions; a $Y_2O_2S$:Eu system phosphor treated to be used for low speed electron beam and which emits red light; or a ZnS:Ag system phosphor which emits blue light depending upon the object of the application of the fluorescent display apparatus.

According to the present invention, the phosphor layers *7a* are formed on the surface of the anode conductors 5 by printing the phosphor, for example, ZnO:Zn system phosphor. Thus, it a required to prepare a phosphor paste in order to be capable of printing the phosphor.

The phosphor paste is prepared by uniformly mixing the phosphor in a vehicle consisting of a binder as a film forming element and a solvent for dissolving the binder so that the resultant paste may have an adequate viscosity suitable for printing.

As the constituent of the phosphor paste, the binder is critical and important. The binder must be selected from such materials that have properties of changing its phase from the liquid state to a solid state by volatilizing the solvent in which the binder is dissolved, thereby forming a solid film to deposit the phosphor on the anodes 5, and that have a decomposition temperature of under 450° C. and can be removed from the solid film by the decomposition or the like when heated at a temperature higher than the decomposition temperature. For example, cellulose derivatives such as nitrocellulose and ethyl cellulose or synthetic resins can be used as the binder. The solvent used in the vehicle may be an organic solvent having an adequate volatilization speed and no nonvolatile component, such as, for example, alcohol.

Figure 4:
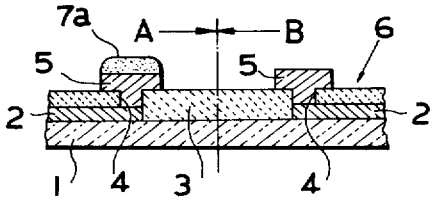

The phosphor paste prepared with the materials as described hereinabove is applied to the upper surface of the anode 5 of the anode substrate 6 in the section A by printing as shown in FIG. 4, thereby forming the phosphor layers *7a*.

Then, the anode substrate 6 on which the phosphor layers *7a* are deposited is subjected to dry naturally or heat at a temperature lower than the decomposition temperature of the binder, for example below 200° C., thereby to volatilize the solvent.

In this state, the binder loses its liquidity and stiffens to form the solid film for depositing the phosphor layer *7a* on the upper surface of the anode conductors 5. In other words, the phosphor layers *7a* are deposited on the anode conductors as the solid film.

Then, second phosphor layers *7b* having a luminous color which is different from that of the phosphor layers *7a* are deposited on the upper surface of the anode conductors 5 provided on the anode substrate 6 in the section B by printing.

When the phosphor layers *7a* are made of a ZnO:Zn system phosphor which emits green luminous color, the phosphor layers 7b are formed of, for example, a $Y_2O_2S$:Eu system phosphor which emits red luminous color.

The phosphor layers 7b can be deposited on the anode conductors 5 in the section B by printing a phosphor paste which is prepared by mixing and dispersing preselected phosphor uniformly in a vehicle. The phosphor paste used in depositing the phosphor layers 7b may be formed of the same vehicle as that used in depositing the phosphor layers 7a which consists of the solvent into which the binder is dissolved and the phosphor is dispersed, or the phosphor paste consisting of a solvent into which a phosphor is dispersed without the addition of the binder can be used.

When printing the phosphor layers 7b, the phosphor layers 7a deposited on the anode conductors 5 in the section A prior to the deposition of the phosphor layers 7b are subjected to be pressed by a printing screen. However, there is no possibility of crushing the deposited phosphor layers 7a by the pressure of the printing screen, or sticking the phosphor to the printing surface of the screen by peeling off the deposited phosphor layers 7a from the anode conductors 5, because the phosphor layers 7a are in the condition of the solid film by the binder. Accordingly, in the present invention, the phosphor layers 7b can be deposited on the anode conductors 5 without decreasing the luminous efficiency of the phosphor layers applied in the prior process even if the phosphor layers are repeatedly printed on the same anode substrate or staining the printing surface of the screen.

Figure 5:
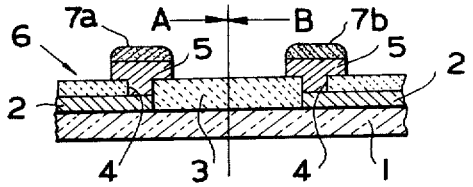

In this manner, the phosphor layers 7a and 7b each having different luminous color are deposited on the anode substrate 6 in the respective sections A and B as shown in FIG. 5.

Then, the anode substrate 6 is subjected to a heat treatment by baking in order to remove the binder for maintaining the phosphor layer 7a in the solid state, and the binder and the solvent contained in the phosphor layer 7b from the phosphor layers 7a and 7b by decomposing and burning the binder and the solvent, and also to remove the impurities deteriorating the illumination of the phosphor or adhering to the anode substrate. When the anode substrate is made of glass, the baking may be conducted at the temperature of about 500° C. taking the softening point of glass into consideration.

As a result of the heat treatment of the anode substrate, the impurities which are deleterious to the luminous efficiency of the phosphor layers 7a and 7b are completely removed, thereby to provide the anode substrate 6 which is used for the fluorescent display apparatus shown in FIGS. 1 and 2.

The fluorescent display apparatus shown in FIG. 2 includes a filamentary cathode 9 mounted above the anode substrate 6 which emits thermions when electrically heated, and a mesh-shaped control electrode 10 disposed between the cathode 9 and the anode substrate 6 for accelerating and controlling the thermions.

The anode substrate 6 is airtightly sealed by a flatbottom boat shaped front cover 11 having a transparent viewing window at the peripheral portions of the anode substrate to provide an evacuated casing in which each of the electrodes is contained. Lead-in wires 12 airtightly passing through the peripheral sealing portions between the anode substrate 6 and the upper cover 11 are electrically connected to the respective ends of the wiring conductors 2 so that a drive signal may be supplied with each of the electrodes.

According to the method of manufacturing the fluorescent display apparatus according to the present invention, the phosphor layers 7a deposited on the anode conductors 5 by printing are stiffened by the binder to form the solid film, and then the subsequent deposition of the phosphor layers is conducted. Therefore, there is no problem of crushing the phosphor layers 7a during the printing of the phosphor layers 7b or peeling off the deposited phosphor layers 7a from the anode conductors 5 which results in the stain on the printing surface of the screen, and the deposition of the phosphor layers 7a and 7b both on the sections A and B can be performed by printing which is heretofore impossible.

Accordingly, the process for the application of the phosphor layers 7a and 7b can be extremely simplified. Furthermore, it is possible to deposite the phosphor layers in a delicate pattern or in a region where the phosphor layers of various different colors are required to the deposited in a complicated manner.

In addition, the phosphor layers 7a and 7b in the optional shape can be easily formed on the anode conductors 5 irrespective of the shape of the anode conductors 5.

In the embodiment described hereinabove, the present invention has been described in connection with the method of manufacturing the fluorescent display apparatus for indicating an input signal as an analog display as shown in FIG. 1, however, it is needless to say that the present invention can be applied to the method of manufacturing such fluorescent display apparatus as shown in FIGS. 6, 7 and 8.

In a display section shown in FIG. 6, segment anodes 21 are disposed in the shape of the letter 8 to form one digit of the display section 22. A display section 23 shown in FIG. 7 is formed of dot or rectangular anodes 24 in a matrix form at a regular interval. The anodes 21 and 24 disposed in the sections A and B divided by the dotted line are formed of the phosphor layers each having a different color. Such phosphor layers can be deposited on the respective anodes 21 and 24 in the sections A and B by printing in the same manner as described hereinabove.

A display section of the fluorescent display apparatus shown in FIG. 8 includes an analog display section 25 and a digital display section 26 in one display panel. The display section is divided into two sections A and B as shown by the dotted line in such a manner that each of the anodes is arranged in complex and deposited the phosphor layers having different luminous colors.

In the display section of the fluorescent display apparatus shown in FIG. 8, the phosphor layer can be deposited on the respective sections A and B by printing in the same manner as described hereinabove. According to this printing method of the phosphor layer, there is no problem of damaging the phosphor layers which result in the decrease in the luminous efficiency of the phosphor layers in the respective sections A and B. Furthermore, the phosphor layers can be deposited on the anodes in the respective sections without contaminating the phosphor layers in one section by the phosphor layers in another section, which results in forming undesirable phosphor layers having spotted mixed colors on the anodes.

In the conventional precipitation and electro-deposition process, it is difficult to deposite phosphor layers on anodes of each of the sections where a plurality of the anodes are arranged in complex for the illumination of different color without casing stain on the phosphor layers in one section by the phosphor layers in another section. However, according to the method of the present invention, it is possible to deposite the phosphor layers on the complicated display area and to produce the anode substrate having the complicated dipslay pattern as shown in FIG. 8.

The present invention has been explained with reference to the embodiments shown in FIGS. 1 through 8 in which the display section is divided into two sections, each having the anodes with the phosphor layers emitting different luminous colors. However, it should be understood that the display area for making the luminous display of different colors is not limited to two sections. The present invention can be applied to a fluorescent display apparatus which includes the display area divided into more than three sections for the luminous display of the numerals, symbols, or the like in different colors in each of the sections.

As explained hereinabove, the method of manufacturing the present invention comprises the steps of applying the phosphor layers to the anodes by printing, which is made of a phosphor paste containing binder which forms a solid film at a temperature lower than the decomposition temperature and can be eliminated by heating at a higher temperature than the decomposition temperature, and gives no obstruction to the light emitting efficiency of the phosphor layer, until the final printing step of the phosphor layer to the anodes. The printing in each step is performed after the previously printed phosphor layers have been solidified by the binder, so that the preceeding printing step may not cause to damage the phosphor layers for decreasing the luminous efficiency and peeling off the printed phosphor layers previously deposited and any stain on the printing face of screen.

Accordingly, phosphor layers in all sections or portions of the display section can be applied with the use of printing technique, thus manufacturing process being significantly simplified.

Further, in the method of manufacturing fluorescent display apparatuses according to the invention, since phosphor layers constituting anodes in one section or portion may not be stained with phosphor having different luminous color, all anodes in all the sections or portions can emit lights of predetermined colors, thus high quality display being obtained.

Further, in the method of manufacturing fluorescent display apparatuses according to the invention, minute patterns of phosphor layer can easily be obtained independently of the shape of anode conductors constituting anode. Further, for an display area wherein portions offering a display with different luminous colors are interdigitated with respect to one another, phosphor layers can be easily applied, thus the invention having great advantage in manufacturing display apparatuses which are adapted to display numerals, letters or pattern with discriminative colors.

Although the invention has been shown and described in terms of a preferred embodiment thereof it should be understood that many changes and modifications will be obvious to one skilled in the art without departing from the true spirit and scope of the invention as defined in the appended claims.

What is claimed as new and desired to be secured by Letters Patent of the United States is:

1. A method of manufacturing a fluorescent display apparatus divided into a plurality of sections each having a plurality of anode conductors disposed on a base plate made of glass or ceramics, wherein phosphor layers are applied on the anode conductors in each of the sections using phosphors of different luminous colors to obtain a plurality of display sections for illuminating different luminous colors upon impingement of electrons, comprising the steps of:

forming a first phosphor paste comprising a phosphor compound capable of emitting a particular luminous color, a volatile solvent and a solid film forming element decomposable by the application of heat at a temperature under 450° C., but higher than the volatilization temperatures of the solvent;

forming a second phosphor paste consisting of a phosphor compound capable of emitting a particular luminous color different from that of the first phosphor paste, a volatile solvent, and without a film forming element;

nextly screen printing said first paste to the anode conductors of one of the sections of said display apparatus;

volatilizing the solvent of the screen printed paste after the screen printing thereof at a temperature above the volitalization temperature of the solvent and below the decomposition temperature of the solid film forming element into a solid film;

nextly depositing said second paste on the anode conductors of the remaining section of said display apparatus; and baking the base plate with the phosphor films formed thereon at a temperature of about 500° C. to eliminate the film forming element from the first phosphor paste, leaving only the respective phosphor compound on the anode conductors on each respective display section.

2. The method of manufacturing the fluorescent display apparatus as defined in claim 1, wherein the film forming element is nitrocellulose.

3. The method of manufacturing the fluorescent display apparatus as defined in claim 1, wherein the film forming element is ethyl cellulose.

4. The method of manufacturing the fluorescent display apparatus as defined in claim 1, wherein the solvent comprises an alcohol.

* * * * *